United States Patent [19]

van Mondfrans et al.

[11] Patent Number: 4,928,585

[45] Date of Patent: May 29, 1990

[54] METHOD FOR CONTROLLING THE PASSAGE OF FABRIC THROUGH A ROTARY SCREEN PRINTING INSTALLATION

[75] Inventors: Gerardus H. van Mondfrans, Sambeek; Pieter de Vries, Boxmeer, both of Netherlands

[73] Assignee: Stork Brabant B.V., Boxmeer, Netherlands

[21] Appl. No.: 254,164

[22] Filed: Oct. 6, 1988

[30] Foreign Application Priority Data

Oct. 9, 1987 [NL] Netherlands ..... 8702409

[51] Int. Cl.[5] ..... B41F 15/12

[52] U.S. Cl. ..... 101/129; 68/202

[58] Field of Search ..... 68/DIG. 5, 205 R, 5 D, 68/5 E, 202; 101/129

[56] References Cited

U.S. PATENT DOCUMENTS

| | | | |
|---|---|---|---|
| 3,292,532 | 12/1966 | Berk et al. | 101/129 X |
| 3,529,447 | 9/1970 | Fleissner et al. | 68/DIG. 5 |
| 3,807,611 | 4/1974 | Eder et al. | 101/118 X |
| 3,889,595 | 6/1975 | Jaffa | 101/129 X |
| 4,009,656 | 3/1977 | Vertegaal | 101/129 |
| 4,101,270 | 7/1978 | Fleissner | 68/DIG. 5 |

FOREIGN PATENT DOCUMENTS

| | | | |
|---|---|---|---|
| 84663 | 6/1980 | Japan | 101/129 |
| 162650 | 8/1985 | Japan | 101/129 |
| 7301424 | 8/1978 | Netherlands . | |

*Primary Examiner*—Clifford D. Crowder

*Attorney, Agent, or Firm*—Kenyon & Kenyon

[57] ABSTRACT

Method for controlling the passage of the fabric through a rotary screen printing installation, whereby a substrate or fabric to be printed is wound from a stock roll and fed into the printing machine of the installation. In order to reduce down times and the waste of mostly expensive substrate the printing machine is set using a fabric of low quality, the so-called leader. The substrate to be printed is sewn to the trailing end of the leader so as to print the substrate after the printing machine is set for first quality printing. The length of substrate is measured and compared with the total length of the print order by means of an electronical processing unit.

5 Claims, 2 Drawing Sheets

METHOD FOR CONTROLLING THE PASSAGE OF FABRIC THROUGH A ROTARY SCREEN PRINTING INSTALLATION

BACKGROUND OF THE INVENTION

The present invention relates to a method for the controlling of a fabric through a rotary screen printing installation, whereby the substrate, the fabric to be printed upon, is wound from a stock roll via a wind-off roller and fed to the printing machine of the installation, and the substrate is then fed through a drying installation and wound up.

A rotary screen printing installation of this type is generally known.

SUMMARY OF THE INVENTION

The object of the present invention is to improve the control of the input such that the down times and/or lower production speeds are reduced.

A further object of the present invention is the automatic registration of the total number of meters of fabric used and the automatic registration of the number of meters of fabric that is printed with first-choice quality.

Finally, it is an object of the invention to carry out a number of checks automatically during printing and to increase the total production speed and to reduce the amount of waste in the form of fabric not printed with first-choice quality.

The above objects of the present invention and others are achieved according to the invention in the following manner:

A predetermined length of a fabric of low quality, the so-called leader, is fed into the installation for setting a printing machine, a portion being stored in a buffer.

A substrate to be printed is sewn to the leader and the length of the print order is stored in the memory of an electronic processing unit.

The printing machine is set whilst emptying the buffer.

The intake of the substrate is started at low speed, a signal for measuring the length of the substrate fed in being given to the processing unit when the seam between the leader and the substrate passes the wind-off roller.

a signal for measuring the length of the printed substrate of first quality is given to the processing unit when the seam has passed through the printing machine and the printing machine is set to first quality.

The measured length of substrate of first quality is compared with the length of the print order stored in the memory.

The use of a leader, being fabric of low quality, has the advantage that the printing machine can be set (brought into register) on inexpensive fabric, so that the amount of waste of the substrate to be printed, which is mostly expensive, can be kept to a minimum. The quantity of leader required, which is necessary for bringing the printing machine into register, is known from experience and dependent on the number of printing positions in operation or of colors required. The substrate to be printed is measured from the point when the seam between the leader and the substrate passes the wind-off roller, so that the total quantity of substrate fed in is measured. A further signal is given to the processing unit from the point when the printing machine is set to print with first quality, so that the length of substrate printed with first quality is also measured. Thus, the total quantity of substrate and the quantity of substrate of first quality are measured in the processing unit, the latter quantity being compared with the length of the print order previously entered in the processing unit. In this way not only is the quantity of fabric used automatically recorded, but the machine can also be set for a minimum percentage of waste of the substrate to be printed, while, as a result of the presence of the buffer, the down times can be reduced or can be avoided.

Preferably, the method according to the invention can be further extended in the following manner.

A signal is given by the electronic processing unit if the difference between the measured length of first quality and the length of the print order is less than a pre-determined value (a).

The speed of the printing machine is brought back to, or kept constant at, a pre-determined value and the speed of the intake is increased to a speed which is much higher than that of the printing machine, so that the buffer is filled.

The feed stops when the length of the substrate required for carrying out the print order has been fed into the intake.

The substrate is cut off and leader sewn firmly onto the trailing end of the substrate and, a signal is given to the processing unit when the seam between the substrate and the leader passes the wind-off roller, by which means the exact quantity of substrate used is known.

The buffer is filled with as much leader as is needed for setting the printing machine for carrying out the subsequent print order; and the printing machine is stopped when the seam between the substrate and the leader has exited from the drying installation.

After completion of the print order, the entire installation is thus filled with sufficient leader to set the printing machine for the following print phase. Since the trailing end of the substrate is again connected to leader, there are, moreover, no changed conditions in the printing installation, so that the final end of the substrate passing through the drying installation shows no deviations with respect to the preceding portion of the substrate.

According to the invention there is also provision that the quantity of substrate on the stock roll is measured during printing and, if the measured length is less than the value (a), the intake is accelerated for filling the buffer until the entire roll has been fed in, a new stock roll is placed in position and the new web is firmly sewn to the trailing end of the preceding web.

If the quantity of substrate on the stock roll at the end of the print order is less than a pre-determined value (b), it is also possible, according to the invention, to feed in the residual portion of the substrate. In this way, the number of stock rolls (docks) with a minimum quantity of residual substrate in the warehouse is reduced.

Thus, with the aid of the method according to the invention, the number of meters of fabric used is recorded automatically, it also being possible to enter in the electronic processing unit from which docks the fabric was taken, so that stock control can also be automated.

Preferably, according to the invention, during actual printing of the substrate the substrate web runs taut through the buffer, and the buffer is then empty.

The invention is illustrated in more detail with the aid of the drawing, wherein:

DETAILED DESCRIPTION

Figure 1:
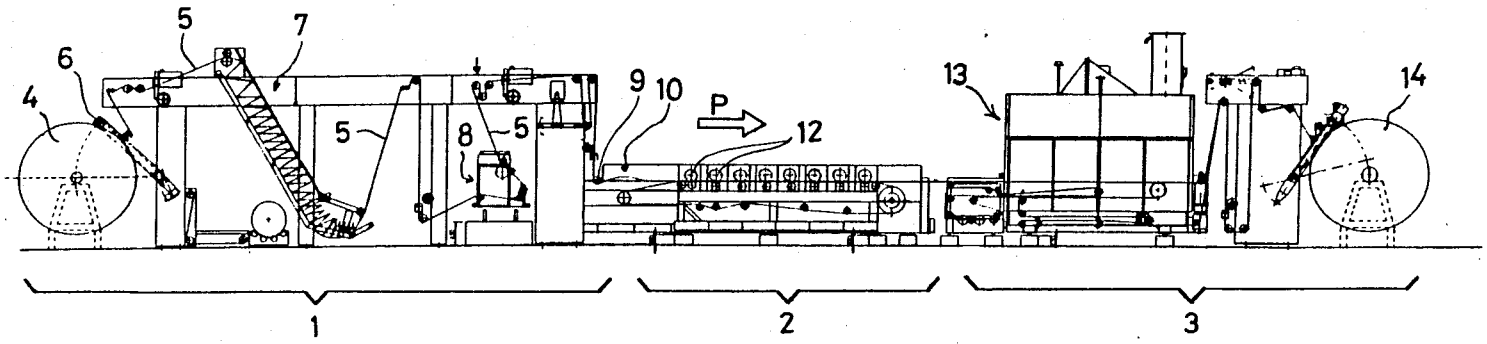
FIG. 1 gives a schematic side view of the rotary screen printing installation.

As can clearly be seen from FIG. 1, the rotary screen printing installation consists of an intake section 1, a printing machine 2 and a take-off section 3. The intake section comprises a stock roll 4 of a substrate to be printed, which runs through the installation according to the web 5 in the direction of the arrow P. In the representation shown schemtically in FIG. 1, the web 5 runs from the stock roll 4 essentially via a wind-off roller 6 through a buffer 7, a pre-treatment installation 8 and a roller 9 via a curved surface 10 to the screen printing machine 2.

The printing machine is provided with a number of parallel cylindrical stencils 12 rotatably bearing-mounted herein. In the embodiment shown, there are eight stencils, which each represent one print position. From the printing machine the web 5 then passes into the take-off section 3. This take-off section essentially comprises a drying installation 13, via which installation the web is wound, via tension adjusting devices and guide rollers, which are not described in more detail, on a stock roll 14.

The screen printing installation shown in FIG. 1 and described briefly here is described in more detail in the related published Netherlands patent application 8702408 of Applicant, to which reference is made here.

Figure 2:
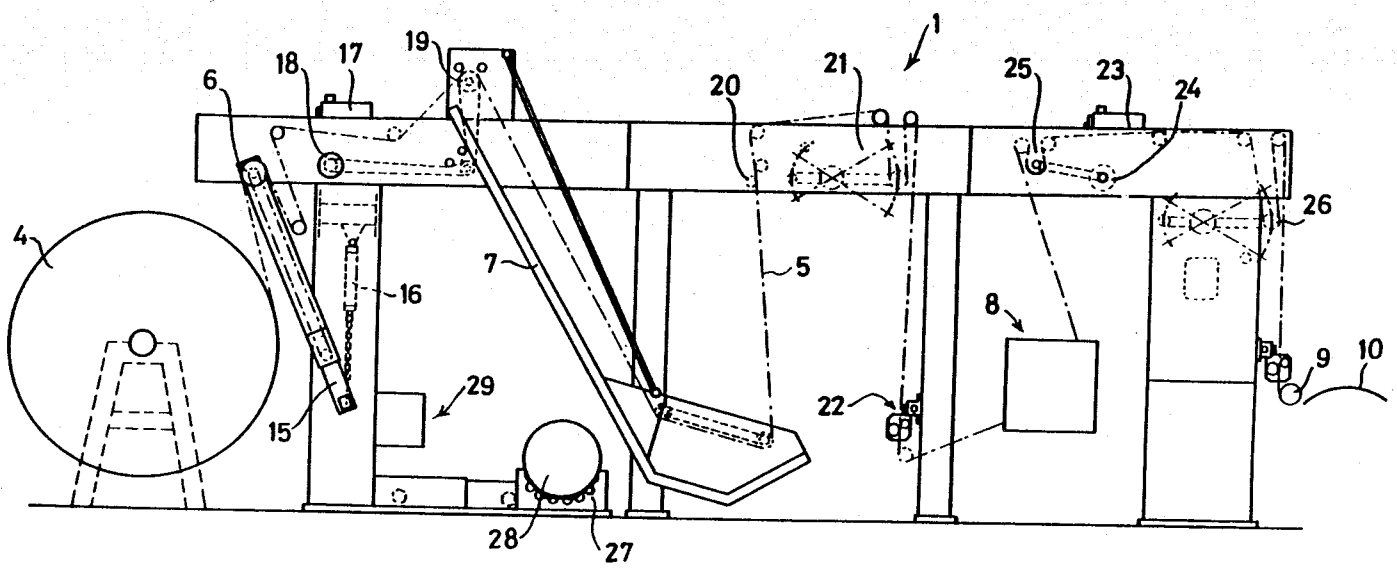
FIG. 2 is an enlarged representation of the intake section of the installation from FIG. 1.

In FIG. 2 the intake section 1 of the installation is shown on an enlarged scale and in more detail. In this figure the same parts are shown as far as possible with the same reference numbers as in FIG. 1. FIG. 2 again shows the stock roll 4 of the substrate to be printed, the substrate being wound off via the wind-off roller 6 located at the outer end of a swivelling lifting arm 15, which lifting arm is operated by a piston-cylinder assembly 16. During the printing process, the lifting arm 15, with the wind-off roller 6, rests against the stock roll 4. The wind-off roller 6, which is provided with a measuring device for the continuous measurement of the length of fabric passing over it, is driven by slip-free chain transmissions with the aid of a motor 17 and a reduction gear unit 18. The web 5 of the substrate to be printed then runs via a drive roller 19 into the buffer 7, which roller 19 is likewise driven by the motor 17 with a circumferential speed which is slightly greater that that of the wind-off roller 6. In contrast to FIG. 1, in FIG. 2 the web 5 runs taut through the buffer 7. As will be described in more detail below, this situation arises during the phrase of actual printing of the substrate. Via the buffer 7, the web then runs through a leveller 20 and a compensator or tension adjuster 21, which regulates the speed of the motor 17 depending on the tension of the fabric. From the compensator, the web 5 then runs to a fabric control device or stretcher 22.

Via this control device, the web runs via the pre-treatment installation 8 (for example for removing dust) to a drive roller 25, which is driven by a motor 23 and a reduction gear unit 24. From this device roller 25, the web runs through a second compensator 26, which regulates the speed of the motor 23 depending on the tension of the fabric. Via this latter compensator, the web 5 is fed via the roller 9 over the curved surface 10, after which the web is fed into the printing machine 2.

The intake section 1 of the rotary screen printing installation also contains a holder 27 for a roll 28 of a fabric of low quality, the so-called leader. As will be described in more detail below, this relatively inexpensive leader serves for setting the printing machine 2 so that, in this way, the loss of relatively expensive substrate as waste can be kept as small as possible. A sewing machine 29 is also provided for sewing the webs to one another when the stock roll is changed.

Before the start of a new print order the entire installation is filled with leader which extends from the roll 28 via guide rollers and the wind-off rollers 6 through the machine in accordance with the web 5 shown. If leader is fed into the installation from the roll 28, the lifting arm 15 is in the raised position shown in FIG. 2. In this starting stage, the buffer 7 is filled with leader so that the web 5 is in loops in the buffer, as shown schematically in FIG. 1. The length of the leader fed in depends on the number of print positions which are needed for carrying out the particular print order and is known from experience.

The data for the print order now to be carried out, i.e. the length of first quality, are entered into an electronic processing unit. The leader is then cut from the roll 28 and, with the aid of the sweing machine 29, the substrate from the stock roll 4 is firmly sewn to the trailing end of the leader fed into the installation. The printing machine 2 is now started at low speed, the operator setting the machine (bringing it into register) while this machin is using the low quality fabric stored in the buffer 7. In the situation that fabric from the buffer is used, the leveller 20 is reversed so that the fabric in front of the leveller, seen in the direction P of movement of the fabric, hangs slack, while beyond the leveller 20 the fabric is kept at tension as a consequence of the friction exerted on the fabric by the leveller.

The leveller 20 can, for example, be controlled by a photo-electric cell which is fitted in the buffer and which recoreds whether or not the buffer is filled. If the buffer is empty, the fabric runs taut through the buffer 7 and the leveller is set such that there is no difference in tension in the web over the leveller 20. In this situation the fabric is kept at tension by the compensator 26, which controls the drive motor 23.

Towards the time that the buffer starts to run empty, the intake of substrate is started via the wind-off roller 6, which rests against the roll 4 and is driven by the motor 17. The fabric now runs taut through the buffer 7 as shown in FIG. 2. If the seam between the leader and the substrate passes the wind-off roller 6, a signal is given to the electronic processing unit, so that from this point the quantity of substrate supplied is automatically measured. When the seam has passed through the printing machine and the operator, in the meantime, has brought the machine into register such that a print of first quality is obtained, a further signal is given to the processing unit, which from this point records the quantity of substrate printed in first quality. In this way, thus, both the total quantity of substrate and the quantity of substrate printed in first quality are measured, the difference between these two amounts being noted as waste.

When the measured length of printed substrate of first quality approaches the total length of the print order previously entered in the processing unit to within, for example, about 300 meters, an acoustic signal is given by the processing unit. The printing speed is automatically brought back to a maximum of 40 m/min., or is kept constant if the printing speed is lower. The intake is now accelerated to a speed of about 100 m/min., so that the buffer is filled until the total number of meters of substrate to be printed for the particular order had been fed in. It will be clear that during this operation the leveller 20 is again reversed so that the fabric can be kept at tension beyond this leveller. The substrate is now cut at the intake and leader is sewn firmly to the trailing end of the substrate fed into the installation, this thus being carried out while the printing machine continues to run and uses substrate from the buffer. The leader is now fed in in synchronization with the speed of the printing machine. When the seam between the substrate and the leader has passed the wind-off roller, a signal is given to the processing unit, the precise number of meters of substrate fed in then being known. As much leader is fed into the buffer as is necessary to set the printing machine for carrying out the subsequent print order, which quantity is known from the experience and is dependent on the number of print positions of the printing machine 2 which are to be used.

When the buffer is filled with sufficient leader, the intake stops, while the printing machine continues to print normally and stops automatically as soon as the final meter of the substrate to be printed has exited from the dryer. The stockroll 4 with residual substrate can be removed and brought back to the stores, after which the installation is ready for carrying out the next print order.

During printing, the quantity of substrate present on the stock roll is also measured, which can be effected, for example, via the angular position of the lifting arm 15 or by measuring the distance between the outer edge of the stock roll and the core of the roll. This value is also entered into the processing unit. If the quantity of substrate remaining on the roll after the print order is complete is less than a pre-determined minimum length, the residual portion of the substrate is automatically also printed until the entire roll has been used. The minumum residual stock which is still acceptable can be changed per print order and/or per roll. In this way it is avoided that a large number of rolls with too small a stock are left over.

In the case of large print orders it can be possible that several stock rolls are needed. If the processing unit establishes, via the measurement of the substrate stock, that this stock is less than 300 meters and the total print order is not yet complete with this, the intake is automatically accelerated to fill the buffer. The entire stock roll is rapidly fed in and the empty roll is then changed for the following roll and the new web is firmly sewn onto the trailing end of the substrate fed into the installation. After the substrate from the new roll has been firmly sewn anys substrate still present in the buffer is pulled through and the intake starts from the new stock roll, the substrate then again running taut through the buffer. In this way the stock roll can be changed without the printing machine having to be stopped. By also entering the numbers of the stock rolls into the processing unit, the warehouse stock control can also be automated.

What is claimed is:

1. A method for controlling the passage of a fabric through a rotary screen printing installation, whereby a web of substrate to be printed upon is wound from a first stock roll via a wind-off roller and fed to a printing machine of the installation, and the substrate is then fed through a drying installation and wound up, comprising the steps of:

A. feeding a leader, a pre-determined length of a fabric of low quality, into the installation, a portion of said leader being stored in a buffer, B. sewing the substrate to be printed to said leader, C. storing the length of a print order in a memory of an electronic processing unit, D. setting the printing machine using said leader, while emptying the buffer, E. starting the intake of substrate at a low speed, F. sending to the processing unit a signal for measuring the length of the strength fed in when the seam between the leader and the substrate passes the wind-off roller, G. sending to the processing unit a signal for measuring the length of the printed substrate of a first quality after the seam between the leader and the substrate has passed through the printing machine and after the printing machine is set to a first quality, H. comparing the measured length of substrate of first quality with the length of the print order stored in the memory.

2. The method of claim 1, further comprising the steps of:

I. the electronic processing unit producing a first signal if a difference between the measured length of substrate of first quality and the length of the print order is less than a pre-determined value (a), J. setting the speed of the printing machine to a pre-determined value and increasing the speed of the intake to a speed which is much higher than said pre-determined value, so that the buffer is filled, K. stopping the intake when the length of the substrate required for carrying out the print order has been fed, L. cutting the substrate and sewing a second leader onto the trailing end of the substrate, M. sending a signal to the processing unit when the seam between the substrate and the second leader passes the wind-off roller, the processing unit using the signal to calculate the exact quantity of substrate used, N. filling the buffer with as much leader as is needed for setting the printing machine for carrying out a subsequent print order, O. stopping the printing machine when the seam between the substrate and the second leader has exited from the drying installation.

3. The method of claim 2, further comprising the steps of: measuring the quantity of substrate on the stock roll during printing and, if the length of the stock roll is less than the value, accelerating the speed of intake to fill the buffer until the entire roll of substrate has been fed in, placing a new stock roll in position and sewing a new web of the new stock roll to the trailing end of the of the first stock roll web.

4. The method of claim 2, further comprising the steps of measuring the quantity of substrate on the stock roll during printing as a residual portion and if the stock at the end of a print order is less than a pre-determined value (b), feeding in the residual portion of the substrate.

5. The method of claim 1, wherein during printing the substrate of the web of substrate runs taut through the buffer and the buffer is thus empty.

* * * * *

UNITED STATES PATENT AND TRADEMARK OFFICE

CERTIFICATE OF CORRECTION

PATENT NO. : 4,928,585

DATED : May 29, 1990

INVENTOR(S) : Gerardus VAN MONDFRANS et al.

It is certified that error appears in the above-identified patent and that said Letters Patent is hereby corrected as shown below:

| Column | Line | Corrections |
|---|---|---|
| Title Page ABSTRACT | 12 | Change "electronical" to --electronic--. |
| 3 | 52 | Change "that" to --than--. |
| 3 | 65 | Change "device" to --drive--. |
| 4 | 27 | Change "sweing" to --sewing--. |
| 4 | 32 | Change "machin" to --machine--. |
| 5 | 55 | Change "anys" to --any--. |
| 6 | 13 | Change "strength" to --substrate--. |
| 6 | 53 | Change "value," to --value (a),--. |
| 6 | 58 | After "the" insert --web--; after "roll" delete "web". |

Signed and Sealed this

Seventh Day of April, 1992

*Attest:*

*Attesting Officer*

HARRY F. MANBECK, JR.

*Commissioner of Patents and Trademarks*